US007543815B2

(12) United States Patent
Barazani et al.

(10) Patent No.: US 7,543,815 B2
(45) Date of Patent: Jun. 9, 2009

(54) GRIPPERS MALFUNCTION MONITORING

(75) Inventors: Avi Barazani, Rehovot (IL); Shaul Rapoport, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 478 days.

(21) Appl. No.: 11/320,456

(22) Filed: Dec. 28, 2005

(65) Prior Publication Data

US 2007/0144368 A1 Jun. 28, 2007

(51) Int. Cl.
*B65H 5/02* (2006.01)

(52) U.S. Cl. ..... 271/277; 271/82; 101/408

(58) Field of Classification Search ..... 271/275, 271/277, 82; 101/408
See application file for complete search history.

(56) References Cited

U.S. PATENT DOCUMENTS 3,949,219 A * 4/1976 Crouse ..... 250/229
4,063,724 A * 12/1977 Suda ..... 271/277
4,390,176 A * 6/1983 Kato ..... 271/270
4,594,597 A * 6/1986 Liu et al. ..... 347/177
4,679,953 A 7/1987 Sone et al.
4,891,655 A 1/1990 Watanabe
4,949,638 A * 8/1990 Watanabe ..... 101/409
5,066,856 A * 11/1991 Crouse ..... 250/229
6,038,968 A * 3/2000 Hara et al. ..... 101/116
6,571,698 B1 * 6/2003 Kagawa ..... 101/128.4

FOREIGN PATENT DOCUMENTS

EP 0432926 6/1991
JP 04292977 10/1992
JP 2004188789 A * 7/2004

* cited by examiner

*Primary Examiner*—Patrick H MacKey
*Assistant Examiner*—Gerald W McClain

(57) ABSTRACT

A system for printing an image on a printing media, comprising:

Figure 1:
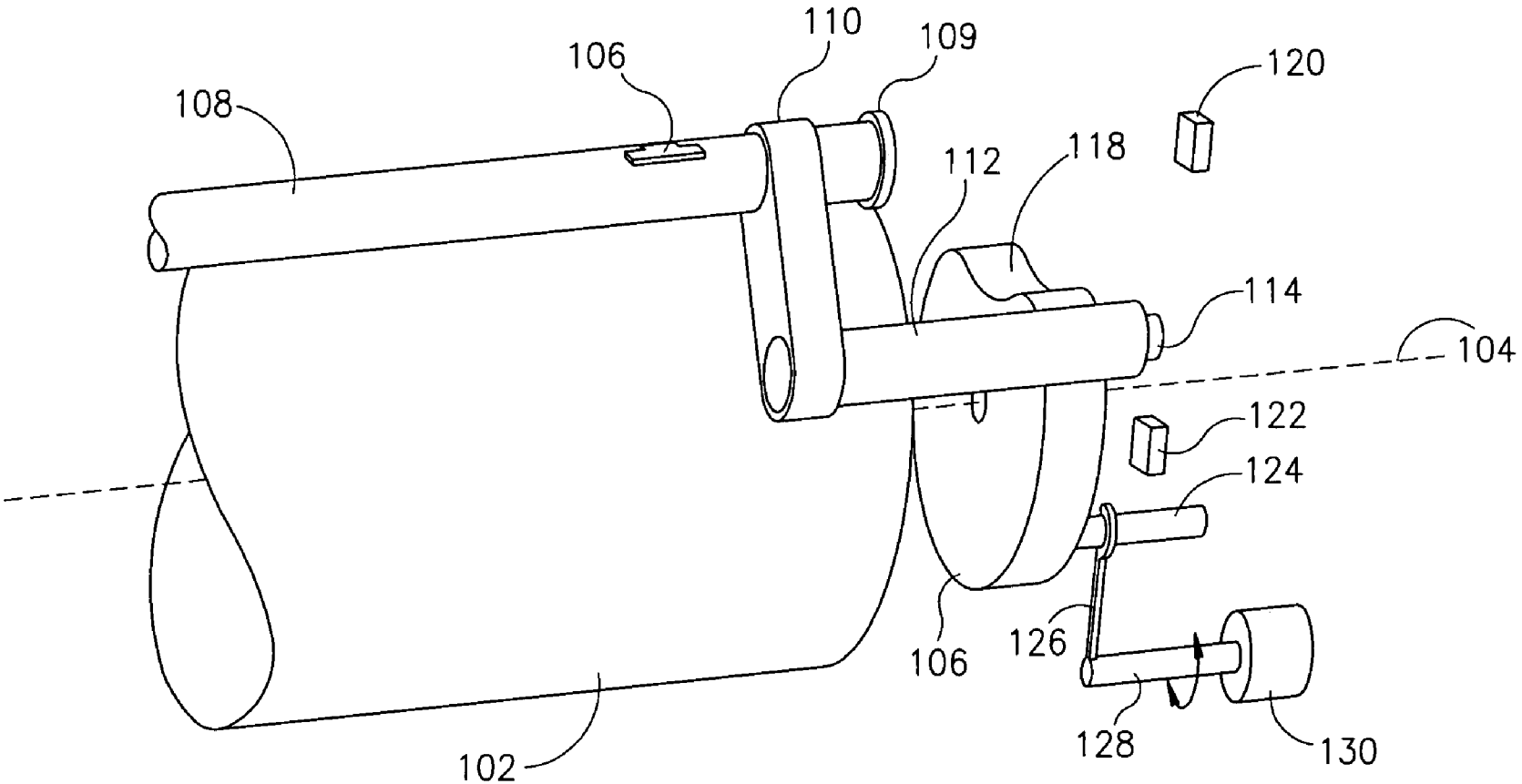

a) an impression roller;

b) a gripper which receives the printing media when said gripper is open, closes to hold the printing media to the impression roller while the image is printed, and opens to release the printing media from the impression roller; and c) at least one sensor which senses whether the gripper is open or closed.

19 Claims, 6 Drawing Sheets

GRIPPERS MALFUNCTION MONITORING

CROSS-REFERENCE TO RELATED APPLICATIONS

This application incorporates by this reference all subject matter contained in PCT Patent Application Serial No. PCT/IL2003/000545, as filed on 29 Jun. 2003, and entitled "GRIPPERS MALFUNCTION MONITORING". This PCT application was published on 13 Jan. 2005 as International Publication No. WO 2005/002864 A1.

FIELD OF THE INVENTION

The field of the invention is printers and copiers, especially apparatus and methods for monitoring malfunctioning of grippers.

BACKGROUND OF THE INVENTION

Printers and copiers often have a photo-sensitive member which receives an image, and an intermediate transfer member, often with a heated blanket, which receives the image from the photo-sensitive member and transfers it to sheet of paper or other printing media on an impression roller. (The printing media will henceforth be referred to as "paper," but any printing media should be understood.) The intermediate transfer member often has a delicate surface, for example the heated blanket may comprise a release surface with a soft conforming layer underneath, which allows the surface to press against the impression roller with uniform pressure. These characteristics of the intermediate transfer member produce good images on the printing media, but also mean that its surface may be damaged relatively easily, and such damage may require a time-consuming and expensive replacement of the member. Even for different structures, the intermediate transfer member (often in the form of a blanket) is subject to damage from excess pressure and/or from toner that is left on the release surface too long.

One cause of such damage is paper sticking to the blanket. Normally, paper is fed onto the impression roller and held there with grippers. If the paper is misfed for any reason, then the paper may stick to the blanket of the intermediate transfer member after the image is printed. The printer must then be stopped, opened up, the paper removed, and the ink on the blanket (which in normal operation gets completely transferred to the paper) must be cleaned off. Delay in removing the ink from the blanket may result in the ink drying onto the (generally heated) blanket, which must then be replaced. Ink may also remain on the intermediate transfer member if, as a result of the paper misfeeding, at least part of the intermediate transfer member presses directly against the surface of the impression roller, without any paper in between. If the paper is folded or wrinkled as a result of the misfeed, it may dent the blanket, also making it necessary to replace the blanket. If paper is not released on time from the impression roller, then two sheets of paper may end up on the impression roller, which can hurt the blanket.

Because paper misfeeds are potentially so damaging, it would be desirable to prevent any events which could cause a misfeed, even relatively rare events.

SUMMARY OF THE INVENTION

An aspect of an embodiment of the invention concerns an apparatus and method for preventing some misfeeds which can damage the blanket, by sensing when the grippers fail to open properly or fail to close properly. Optionally, this is done by two proximity sensors, for example capacitive, inductive or optical sensors, which sense the proximity of a target element which is in a different position depending on whether the grippers are open or closed. Alternatively, the state of the grippers is sensed directly, but sensing the proximity (or lack of proximity) of a target element potentially provides a simpler way to determine the state of the grippers, since the grippers are not generally accessible.

In an embodiment of the invention, the target element rotates with the impression roller. The target element changes its position as the impression roller rotates, while the sensors are fixed in place and sense the target element as it passes them, if the grippers are open. The first sensor is located in a position such that, in normal operation, the grippers would already be open when the target passes the first sensor, if the grippers are supposed to open on that cycle of the impression roller. The second sensor is located in a position such that, in normal operation, the grippers would already be closed when the target passes the second sensor (and hence the second sensor would not sense the target), if the grippers are supposed to close on that cycle of the impression roller. Alternatively, one or both of the sensors are instead located at a position such that they would sense the target only if the grippers were closed. Alternatively, only one of these sensors is present, and only one type of malfunction of the grippers (failure to open, or failure to close) is sensed.

Optionally, the target element is, or is attached to, an element which causes the grippers to open and close. For example, the target element is a cam follower, which follows a cam while rotating with the impression roller, opening and closing the grippers at the proper points in the cycle.

In printers where only one transfer to paper takes place at each print engine, the cam is often fixed in place. The grippers always open and close at the same points in the cycle of the impression roller, which picks up a sheet of paper during each cycle, and releases it before picking up the next sheet during the next cycle. In such a printer, the grippers virtually never fail to open or close properly. However, in printers which print more than one image on each sheet of paper, for example color printers which print several color separations on each sheet of paper, the grippers do not open and close on every cycle, and the cam is not fixed in place. Instead, as in the HP3000 Twister printer using a cam, there is a locking mechanism, in this example a hook which hooks onto the cam, which locks the cam in place when the grippers are supposed to open and close, to release a sheet of paper which is finished being printed, and to pick up the next sheet.

When the grippers are not supposed to open, for example when additional images are going to be printed on the sheet that is being held by the grippers, then the locking mechanism is released, and the cam rotates together with the impression roller and the cam follower. The grippers then remain closed, until the locking mechanism is re-engaged, and the cam follower starts to move relative to the cam again. This process is illustrated in FIGS. 2A-2I, and described in detail below.

In printers with a moveable and lockable cam, the grippers are much more likely to fail to open or fail to close at the proper time. This can occur, for example, if the locking mechanism fails to release, or fails to engage, or if the cam fails to rotate with the impression roller when the locking mechanism is released, or if the cam stops rotating at the wrong orientation when an attempt is made to engage the locking mechanism. While gripper malfunction is very rare, the consequences are harmful and it is desirable to sense gripper malfunction as soon as it occurs.

If the sensors sense that the grippers have failed to open, or failed to close, then optionally the printer is automatically stopped, before damage has been done to the blanket of the intermediate transfer member, and a diagnostic message is issued to the operator.

There is thus provided, in accordance with an exemplary embodiment of the invention, a system for printing an image on a printing media, comprising:

a) an impression roller;

b) a gripper which receives the printing media when said gripper is open, closes to hold the printing media to the impression roller while the image is printed, and opens to release the printing media from the impression roller; and c) at least one sensor which senses whether the gripper is open or closed.

Optionally, the impression roller rotates on a rotation axis, the closing of the grippers occurs within a first angular range in the rotation of the impression roller, the opening of the grippers to release the printing media occurs within a second angular range in the rotation of the impression roller, and the at least one sensors comprise one or both of:

a) a first sensor which senses whether the gripper is open or closed at a first sensor angle in the rotation of the impression roller, which first sensor angle follows the first angular range and precedes the second angular range; and b) a second sensor which senses whether the gripper is open or closed at a second angle in the rotation of the impression roller, which second angle follows the second angular range and precedes the first angular range.

Optionally, the at least one sensors comprise only the first sensor.

Alternatively, the at least one sensors comprise only the second sensor.

Alternatively, the at least one sensors comprise both the first and second sensors.

In an embodiment of the invention, there is a sensor target which has a first position when the gripper is open and a second position when the gripper is closed, and at least one of the at least one sensors is a proximity sensor which detects the target only in one of the first and second positions.

Optionally, the proximity sensor detects the target only in the first position.

Optionally, the proximity sensor is an inductive sensor.

Alternatively, the proximity sensor is a capacitive sensor.

Alternatively, the proximity sensor is an optical sensor.

Optionally, the target is attached to a control element which controls the opening and closing of the gripper.

Alternatively, the target comprises a control element which controls the opening and closing of the gripper.

In an embodiment of the invention, there is a cam, and the control element comprises a cam follower which follows the perimeter of the cam, the grippers being open when the cam follower is on a first portion of said perimeter, and closed when the cam follower is on a second portion of said perimeter.

Optionally, there is a control rod attached to the gripper, and a lever joining the control rod to the cam follower, and the cam follower is on the first portion of the perimeter of the cam, the lever rotates the control rod into an orientation where the gripper is open, and when the cam follower is on the second portion of the perimeter of the cam, the lever rotates the control rod into an orientation where the gripper is closed.

Optionally, there is a cam stopper, the cam does not rotate when the cam stopper is engaged, and the cam rotates substantially in synchrony with the impression roller when the cam stopper is disengaged, thereby preventing the gripper from opening when the cam stopper is disengaged and the cam follower is on the first portion of the perimeter of the cam.

Optionally, friction keeps the cam rotating substantially in synchrony with the impression roller when the cam stopper is disengaged.

Alternatively or additionally, there is a cam attachment mechanism which attaches the cam to the impression roller when the cam stopper is disengaged, thereby keeping the cam rotating substantially in synchrony with the impression roller.

Optionally, the cam stopper comprises a first cam stopper element which is attached to the cam, and a second cam stopper element which is fixed in place, and the cam stopper elements engage each other to engage the cam stopper, and disengage to disengage the cam stopper.

Optionally, there is an actuator which moves one of the cam stopper elements into a first position where it engages the other cam stopper element, and into a second position where it disengages the other cam stopper element.

Optionally, the cam only stops at a stopping position, and the cam stopper element moved by the actuator does not interfere with the rotation of the cam when said element is in the first position, until the cam is substantially in the stopping position.

Optionally, one of the cam stopper elements is a hook.

There is thus also provided, in accordance with an exemplary embodiment of the invention, a method of preventing damage to an intermediate transfer member in a printer with a rotating impression roller, and a gripper which has an open position and a closed position, which gripper holds a printing media to the impression roller when the gripper is closed but not when the gripper is open, the method comprising:

a) feeding the printing media onto the impression roller when the gripper is open and the impression roller is oriented at a first range of angles in its rotation;

b) closing the gripper to hold the printing media onto the impression roller when the impression roller is oriented at a second range of angles in its rotation;

c) transferring an image from the intermediate transfer member to the printing media while the printing media is held onto the impression roller;

d) opening the gripper to release the printing media from the impression roller after the image is transferred, when the impression roller is oriented at a third range of angles in its rotation; and e) sensing at least one of: a failure of the gripper to be open to receive the printing media, a failure of the gripper to close to hold the printing media, a failure of the gripper to stay closed until after the image is transferred, and a failure of the gripper to open to release the printing media.

Optionally, sensing comprises sensing, a failure of the gripper to be open to receive the printing media.

Alternatively or additionally, sensing comprises sensing a failure of the gripper to close to hold the printing media.

Alternatively or additionally, sensing comprises sensing a failure of the gripper to stay closed until after the image is transferred.

Alternatively or additionally, sensing comprises sensing a failure of the gripper to open to release the printing media.

In an embodiment of the invention, the method includes stopping the printer after at least one of the failures has been sensed, before said failure causes damage to the intermediate transfer member.

Optionally, sensing comprises sensing whether the gripper is open or closed when the impression roller is oriented at an angle that it reaches in its rotation after passing the second range of angles and before reaching the second range of angles, thereby sensing failure of the gripper to close and failure of the gripper to stay closed.

Additionally or alternatively, sensing comprises sensing whether the gripper is open or closed when the impression roller is oriented at an angle that it reaches in its rotation after passing the third range of angles and before reaching the first range of angles, thereby sensing failure of the gripper to open and failure of the gripper to be open.

Optionally, sensing whether the gripper is open or closed when the impression roller is oriented at an angle comprises detecting the proximity or lack of proximity of a target to a proximity sensor, and the target passes near the sensor only when the impression roller is oriented at said angle, and only when the gripper is in one of an open state and a closed state, but not when the gripper is in the other of said states.

BRIEF DESCRIPTIONS OF THE DRAWINGS

Exemplary embodiments of the invention are described in the following sections with reference to the drawings. The drawings are generally not to scale and the same or similar reference numbers are used for the same or related features on different drawings.

FIG. 1 is an exploded view of one end of an impression roller with grippers, showing a mechanism for opening and closing the grippers, according to an exemplary embodiment of the invention. The gripper 106, gripper control rod 108, bearing 109, lever 110, cam follower 112, sensor target 114, and sensors 120 and 122 are shown outside the impression roller 102 for clarity and to reveal details which would otherwise be concealed by the impression roller 102.

Figure 2A:
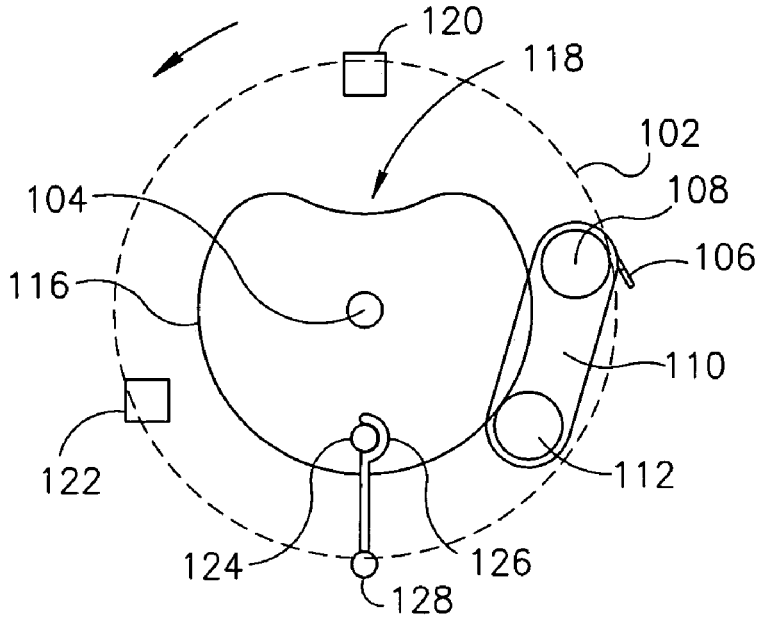
Figure 2B:
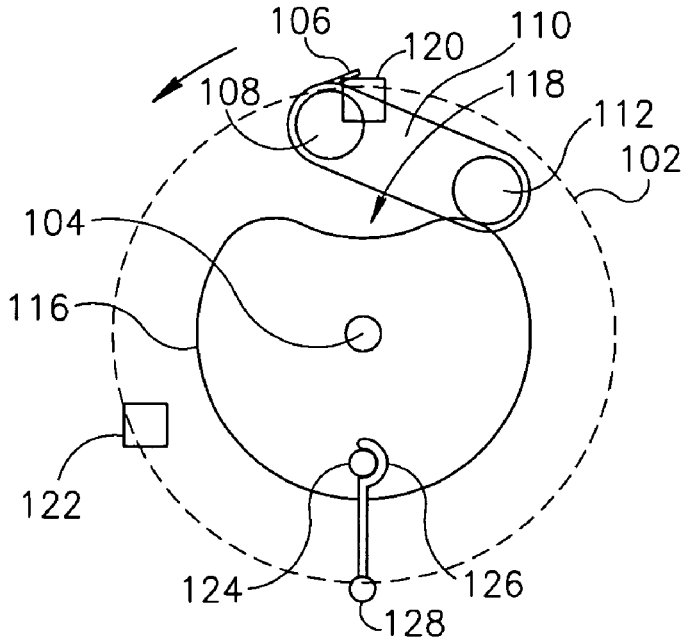
Figure 2C:
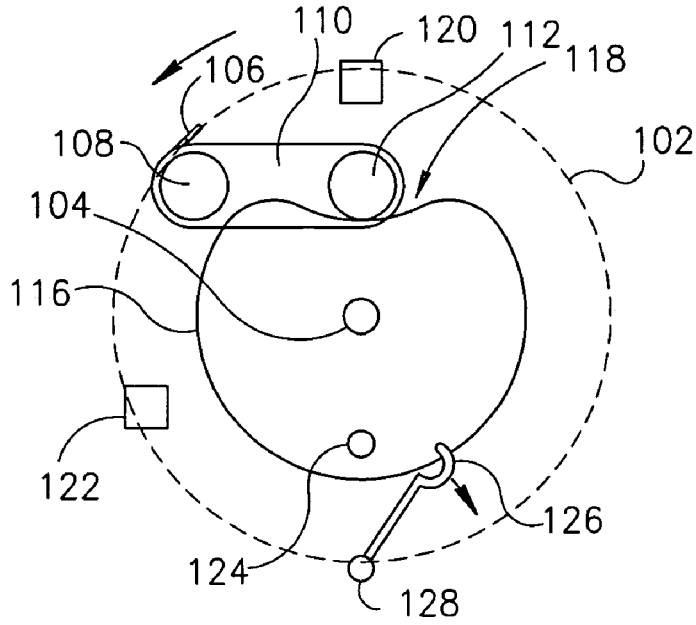
Figure 2D:
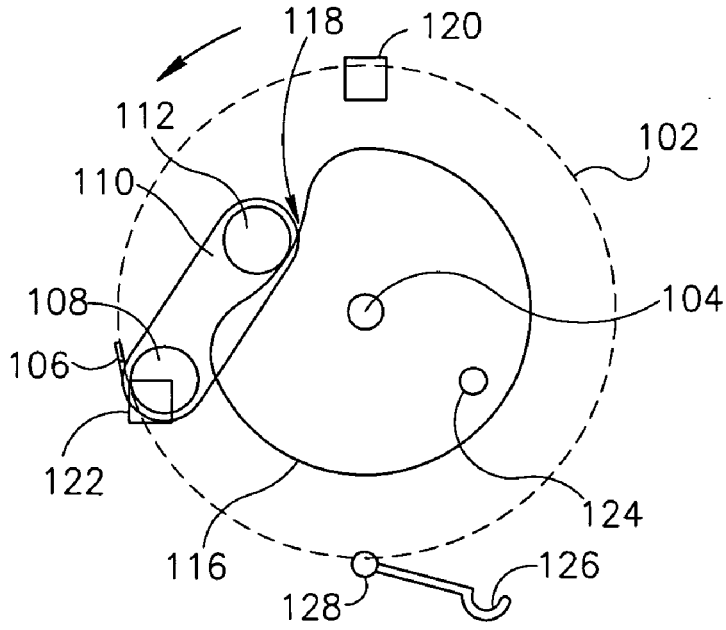
Figure 2E:
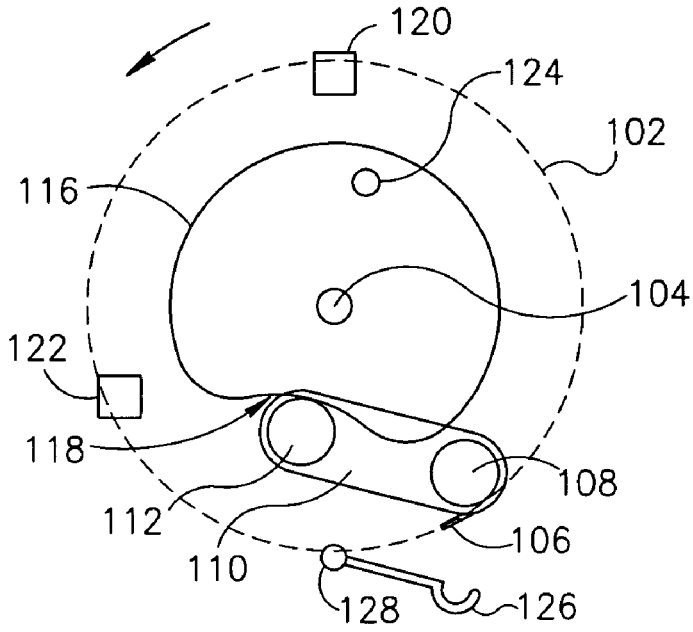
Figure 2F:
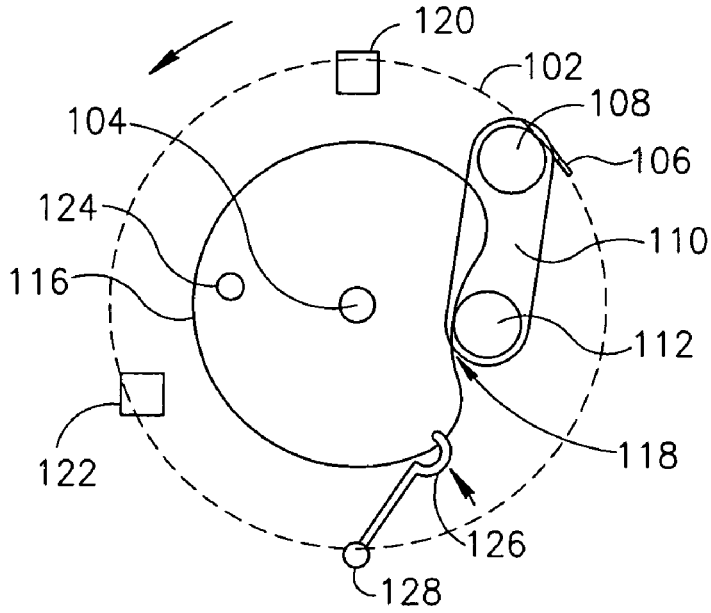
Figure 2G:
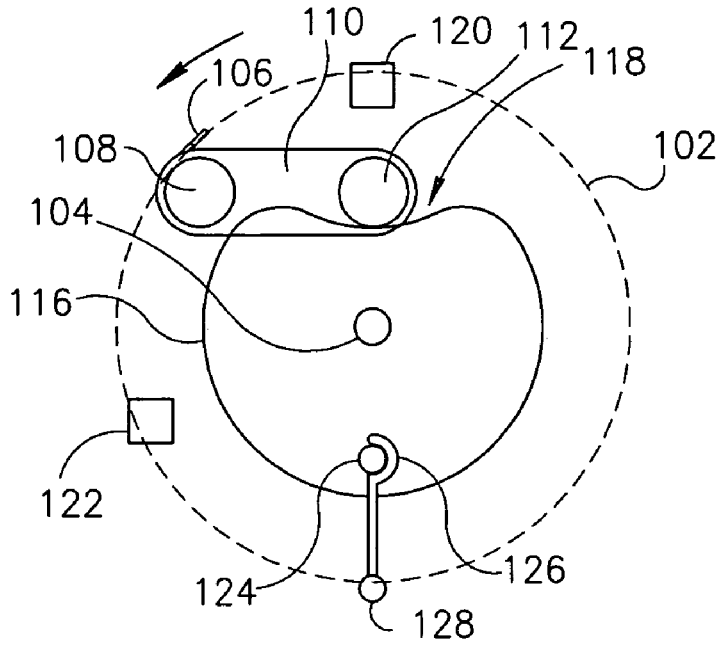
Figure 2H:
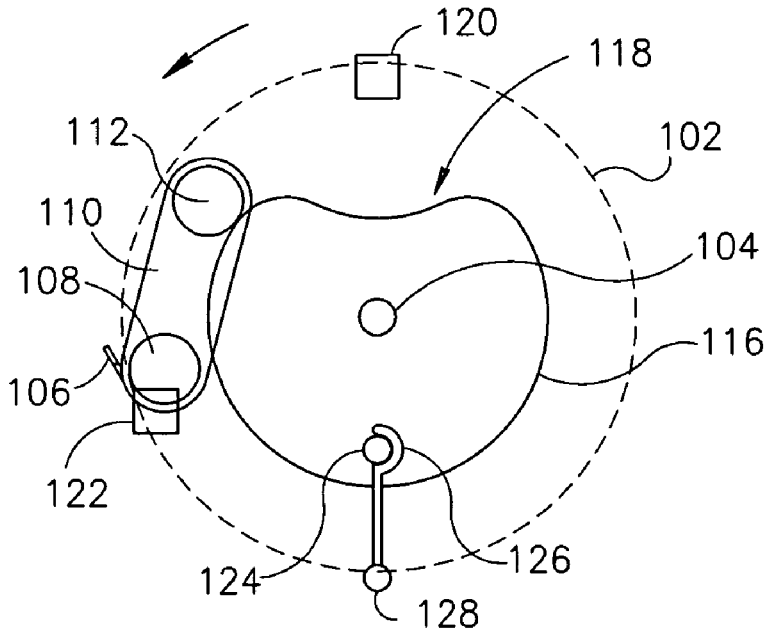
Figure 2I:
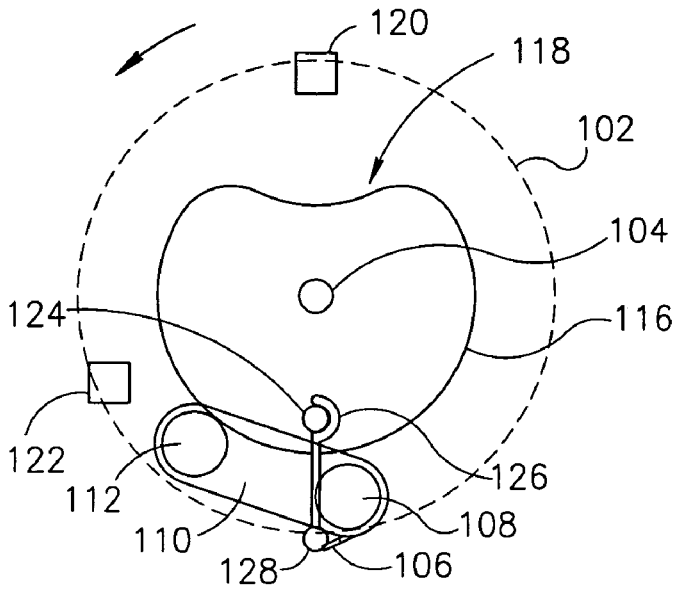
Figure 3:
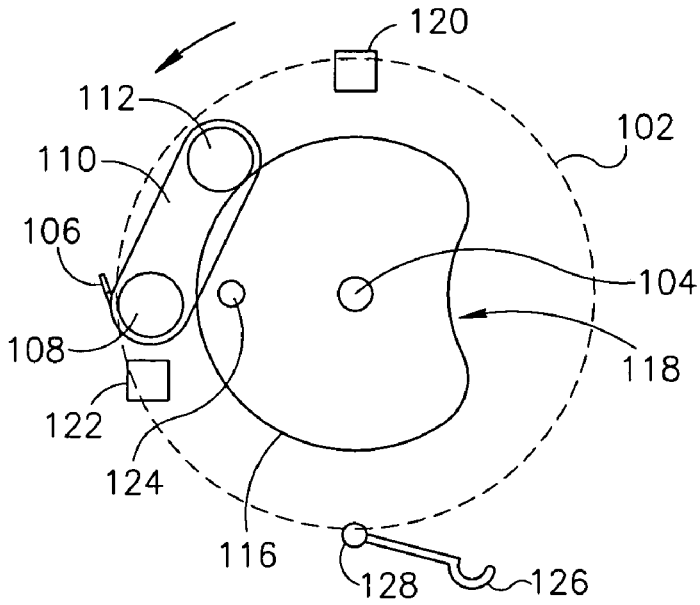

FIGS. 2A-2I are a time sequence of schematic axial views showing the operation of the mechanism, according to the same embodiment of the invention; and FIG. 3 is an axial view showing a situation in which the grippers fail to close, according to the same embodiment of the invention.

DETAILED DESCRIPTION OF EXEMPLARY EMBODIMENTS

FIG. 1 shows one end of an impression roller 102 in a printer or copier, in accordance with an embodiment of the invention. The impression roller rotates continuously around an axis 104 during normal operation of the printer or copier. A gripper 106 is opened and closed by the rotation of a gripper control rod 108, which is mounted in a bearing 109 that is attached to the impression roller. Optionally there are one or more additional grippers not shown in the drawing, located for example further to the left of the gripper shown, which are also opened and closed by control rod 108. A lever 110 attaches control rod 108 to a cam follower 112. When cam follower 112 moves radially outward from axis 104, lever 110 causes control rod 108 to rotate in a direction which opens gripper 106. When cam follower 112 moves radially inward, then lever 110 causes control rod 108 to rotate in the other direction, which closes gripper 106. Alternatively, cam follower 112, lever 110, contrail rod 108, and gripper 106 are configured so that moving cam follower 112 outward causes gripper 106 to close, and moving cam follower 112 inward causes gripper 106 to open. In describing the drawings, we will assume that moving cam follower 112 inward causes gripper 106 to close, but the appropriate changes in the description, if the reverse is true, will be obvious to one skilled in the art.

In an embodiment of the invention, a sensor target 114 is situated at or near the end of cam follower 112, opposite the end of cam follower 112 that is attached to lever 110. Optionally, sensor target 114 is not a separate element added to cam follower 112, but is just the far end of cam follower 112, made of the same material as the rest of cam follower 112.

Cam follower 112 follows the surface of a cam 116, as impression roller 102 rotates around axis 104. Although cam 116 is shown some distance to the right of impression roller 102, in FIG. 1, for clarity, cam 116 is optionally directly in contact with the end of impression roller 102. Cam 116 has a depression 118 on one side. When cam follower 112 moves into depression 118, then gripper 106 closes, by the mechanism described above. When cam follower 112 moves out of depression 118, then gripper 106 opens.

A first position sensor 120 is located directly to the right of, and somewhat above, depression 118. When cam follower 112 falls into depression 118, then sensor target 114 at the end of cam follower 112 will be located radially inward from sensor 120, and sensor 120 will fall to detect target 114. However, if cam follower 112 fails to fall into depression 118, but remains at the same distance from axis 104 as it normally is when gripper 106 is open, then target 114 at the end of cam follower 112 will be located at the same radius as sensor 120, which will detect target 114 as it sweeps by sensor 120 in the course of the rotation of impression roller 102.

A second position sensor 122 is optionally located at the same radial distance from axis 104 as sensor 120, but at a different azimuthal position. As cam follower 112 follows outside of cam 116, target 114 will go past sensor 122, which will detect it. However if, as will be described below, cam 116 and depression 118 rotate together with impression roller 102, and cam follower 112 remains in depression 118 as impression roller 102 rotates, then target 114 will be too far inward radially to be sensed by sensor 122, as cam follower 112 goes past sensor 122.

Alternatively, sensor 120 and/or sensor 122 are located in positions so that they will only detect target 114 if cam follower 112 is in depression 118 when it passes the sensor.

Optionally, sensors 120 and 122 are inductive sensors. Alternatively, they are capacitive sensors, or optical sensors, or any other kind of proximity sensor known to the art. Optionally, the two sensors are not the same kind of sensor, although, using the same kind of sensor for both sensor 120 and sensor 122 has the potential advantage of making the design and operation of the apparatus simpler. Optionally, only one of sensor 120 and sensor 122 is present but having both sensors present has the potential advantage that the sensor can detect both failure of the grippers to open and failure of the grippers to close.

A rod 124, attached to cam 116, is restrained by a hook 126, to keep cam 116 fixed in place while impression roller 102 rotates. Hook 126 is attached to an axle 128, which is turned by a control motor 130. The control motor brings hook 126 upward, where it catches rod 124, to lock cam 116 in place, and brings hook 126 downward to a position where hook 126 does not interfere with rod 124, to unlock cam 116. Alternatively, any other actuator known to the art, for example a solenoid, is used instead of control motor 130 and axle 128, to move hook 126 back and forth. Alternatively, another reversible attachment mechanism known to the art, such as a clamp or a latch, or a rod which fits into a hole, serves to keep cam 116 fixed in place instead of hook 126 and rod 124. A potential advantage of using hook 126 and rod 124 over some other attachment mechanisms is that the hook can be moved into a position to catch rod 124 any time after rod 124 has passed by that position on the previous rotation of the cam, and the hook will stop the cam at the proper time, but will not interfere with the rotation of the cam until rod 124 reaches the hook.

Although rod 124 is shown at the bottom of cam 116, optionally rod 124, or whatever attachment mechanism is used, is located anywhere where it can conveniently hold the cam in place, and where it does not interfere with other elements, for example the cam follower.

When hook 126 is moved away from rod 124, then cam 116 is free to rotate around axis 104, and does rotate around axis 104, in synchrony with impression rotor 102. For example, friction between cam 116 and impression roller 102 keeps them rotating together when hook 126 does not prevent cam 116 from rotating. Alternatively, cam 116 is attached to impression roller 102 by another pin or a latch or any other reversible attachment mechanism, when hook 126 does not interfere with rod 124. Alternatively, separate synchronized motors are used to drive impression roller 102 and cam 116. Using friction to keep cam 116 and impression roller 102 rotating together has the potential advantage that it is not necessary to actively drive cam 116, or to activate a separate attachment mechanism, but simply removing hook 126 from rod 124 makes cam 116 rotate together with impression, roller 102. Alternatively, cam follower 112 and depression 118 are used to keep cam 116 rotating together with impression roller 102, as described below.

The details of how impression roller 102 and cam 116 are mounted are not shown, for clarity. Optionally, impression roller 102 and cam 116 are both mounted on a common axle along axis 104, for example, or any kind of rotary bearing known to the art is used. Similarly, the mechanism used to drive impression roller 102 is not shown in FIG. 1, and may be any kind of rotary drive mechanism known to the art.

The normal operation of the cam and cam follower in an exemplary embodiment of the invention will be described with reference both to FIG. 1, a side view, and FIGS. 2A through 2I, which provide a time sequence of axial views. The operation may be easier to understand by looking at both FIG. 1 and the series of FIGS. 2A-2I together. In the axial view of FIGS. 2A-2I, the outer surface of impression roller 102 is shown as a dashed circle surrounding cam 116, although in fact, as seen in FIG. 1, cam 116 is located at a different axial position than impression roller 102. In FIGS. 2A-2I, gripper 106 is in an open state when it is oriented at an angle to the surface of impression roller 102, and in a closed state when it is tangent to the surface of impression roller 102.

In a first mode of operation, cam 116 is held in place by hook 126 when the impression roller is waiting for paper. This is shown in FIG. 2A, where hook 126 is shown hooked around rod 124. Depression 118 in cam 116 is located at a position such that gripper 106 will be in the open position when paper is fed into gripper 106, as in FIG. 2B, and gripper 106 then closes around the paper, as in FIG. 2C, holding the paper to impression roller 102. Note that when cam follower 112 falls into depression 118 and gripper 106 closes, as in FIG. 2C, cam follower 112 does not pass next to sensor 120, but passes below sensor 120, and sensor 120 does not detect target 114 (not shown in FIGS. 2A-2I) which is attached to cam follower 112. Optionally, depression 118 is positioned so that gripper 106 closes shortly after the paper is fed into the gripper, and the paper does not have time to slip out of the gripper after it is fed in. Although FIGS. 1, 2A, and 2B show depression 118 located on the top of cam 116 when cam 116 is held in place by hook 126, the actual position of depression 118 need not be on the top of cam 116 when cam 116 is held in place by hook 126.

Once gripper 106 closes around the paper, hook 126 starts to swing downward, away from rod 124, releasing cam 116, as shown in FIG. 2C, and cam 116 begins to rotate with impression roller 102, as shown in FIGS. 2D, 2E, and 2F. Cam follower 112 thus remains in depression 118, and gripper 106 remains closed around the paper, as impression roller 102 rotates. Note that, because cam follower 112 remains in depression 118, cam follower 112 does not pass next to sensor 122, but passes to the side of sensor 122 in FIG. 2E, and target 114 is not detected by sensor 122, indicating that gripper 106 is closed.

A printed image is then transferred to the paper from the intermediate transfer member, not shown in the drawing. Optionally, this is done in a single rotation of the impression roller. Optionally, if only a single image is being printed on the paper, then hook 126 is not removed from rod 124 at all, so FIGS. 2D, 2E and 2F are skipped, and, the image is printed during, the fraction of a cycle when the grippers are closed. Alternatively, for example in color printing, two or more rotations of the impression roller are used in order to print the full image on the paper. Cam 116 continues to rotate synchronously with impression roller 102, and gripper 106 remains closed around paper, while the image is printed. Optionally, the trapping of cam follower 112 in depression 118 is sufficient to keep cam 116 rotating in synchrony with impression roller 102. Alternatively, other mechanisms are used, as described previously.

When the image has been printed and it is desired to remove the paper from the impression roller, then hook 126 swings back upward, as shown in FIG. 2F, until it is in position to catch rod 124, as shown in FIG. 2G. Cam 116 then stops rotating and remains fixed in place with depression 118 at its original location, for example on top of cam 116 as shown in FIG. 2G. As impression roller 102 and cam follower 112 continue to rotate around axis 104, cam follower 112 goes out of depression 118 and moves outward from axis 104, as shown in FIG. 2H. This causes lever 110 to rotate control rod 108, opening gripper 106 when impression roller 102 is in a proper orientation to release the paper. As impression roller 102 continues to rotate, cam follower 112 continues to follow the surface of cam 116. This time, as shown in FIG. 2I, cam follower 112 passes right by sensor 122, and sensor 122 detects target 114 on cam follower 112, indicating that gripper 106 is open. Impression roller 102 and cam follower 112 return to the position shown in FIG. 2A, where gripper 106 is ready to receive the next piece of paper.

If hook 126 fails to catch rod 124 when impression roller 102 is in the position shown in FIG. 2G, then cam 116 will continue to rotate with impression roller 102, as shown in FIGS. 2D, 2E and 2F, and gripper 106 will fail to open. This means that the paper will not be released, and that gripper 106 will not be able to receive the next sheet of paper. This condition will be detected because sensor 122 will fail to sense cam follower 112, which will be positioned as in FIG. 2E, rather than as in FIG. 2I as it is supposed to be. The printer is then optionally stopped, before the next piece of paper can misfeed and possibly damage the blanket of the intermediate transfer member.

If hook 126 fails to disengage properly from rod 124 when it is supposed to, then cam 116 will not rotate with impression roller 102, but will remain in the orientation shown in FIG. 2C. Then cam follower 112 will go out of depression 118 and gripper 106 will open prematurely, as in FIGS. 2H and 2I, rather than remaining closed as it is supposed to, as shown in FIGS. 2D and 2E. This could lead to the paper sticking to the blanket of the intermediate transfer member. It could also lead to the paper slipping out of place before all of the image has been printed on the paper, with the result that part of the image is printed directly on the impression roller. Since the impression roller may not absorb all of the ink from the intermediate transfer member, as the paper does, this can result in some of the ink remaining on the blanket of the intermediate transfer member and drying, damaging the blanket. The premature opening of gripper 106 will be detected because sensor 122 will detect target 114 when cam follower 112 passes by sensor 122, as in FIG. 2I. The printer is then optionally stopped before any damage is done to the blanket. In the case of damage due to ink drying on the blanket, it is specially important to detect the problem quickly, so that the ink can be cleaned off the blanket before it dries. Using sensor 122 to detect the problem potentially allows the ink to be cleaned off the blanket in time. If the problem is not detected until a paper jam occurs later, for example, then it may be too late to save the blanket because on the ink on the blanket may already be dry.

FIG. 3 shows an example in which gripper 106 fails to close when impression roller 102 reaches the orientation, shown in FIG. 2C, at which gripper 106 is supposed to close. In FIG. 3, cam follower 112 follows cam 116, but cam 116 is oriented in the wrong direction, with depression 118 on the side instead of on top, when the grippers are supposed to close. For example, cam 116 stops rotating when it is at a wrong orientation for stopping, due to a problem with the bearing of cam 116. Such a condition could also cause gripper 106 to open prematurely. The condition shown in FIG. 3, where gripper 106 fails to close, could also be caused by a failure of hook 126 to hold cam 116 in place, causing cam 116 to start rotating with impression roller 102 before cam follower 112 has reached depression 118. The failure of gripper 106 to close, or the premature opening of gripper 106, can cause paper to misfeed or to stick to the blanket of the intermediate transfer member, possibly damaging the blanket.

The condition shown in FIG. 3, whatever its cause, and whether it involves a failure of the gripper to close, or a premature opening of the gripper, will result in sensor 120 detecting target 114 as cam follower 112 passes sensor 120, indicating that gripper 106 is open when it is supposed to be closed. The printer then optionally is stopped, before a paper misfeed does any damage.

Although this description and the claims refer sometimes to paper, the invention may also be used with any other printing media, and the claims cover the apparatus and the method when any printing media is used. Similarly, the term "printer" used in the description or the claims covers any apparatus which prints an image on a printing media, including a copier, for example. The invention has been described in the context of the best mode for carrying it out. It should be understood that not all features shown in the drawings or described in the associated text may be present in an actual device, in accordance with some embodiments of the invention. Furthermore, variations on the method and apparatus shown are included within the scope of the invention, which is limited only by the claims. Also, features of one embodiment may be provided in conjunction with features of a different embodiment of the invention. As used herein, the terms "have", "include" and "comprise" or their conjugates mean "including but not limited to."

The invention claimed is:

1. A system for printing an image on a printing media, comprising:

a) an impression roller;

b) a gripper which receives the printing media when said gripper is open, closes to hold the printing media to the impression roller while the image is printed, and opens to release the printing media from the impression roller; and c) at least one sensor which senses whether the gripper is open or closed;

wherein the impression roller rotates on a rotation axis, the closing of the grippers occurs within a first angular range in the rotation of the impression roller, the opening of the grippers to release the printing media occurs within a second angular range in the rotation of the impression roller, and the at least one sensors comprise one or both of:

a) a first sensor which senses whether the gripper is open or closed at a first sensor angle in the rotation of the impression roller, which first sensor angle follows the first angular range and precedes the second angular range; and b) a second sensor which senses whether the gripper is open or closed at a second angle in the rotation of the impression roller, which second angle follows the second angular range and precedes the first angular range.

2. A system according to claim 1, wherein the at least one sensors comprise only the first sensor.

3. A system according to claim 1, wherein the at least one sensors comprise only the second sensor.

4. A system according to claim 1, wherein the at least one sensors comprise both the first and second sensors.

5. A system according to claim 1, and including a sensor target which has a first position when the gripper is open and a second position when the gripper is closed, wherein at least one of the at least one sensors is a proximity sensor which detects the target only in one of the first and second positions.

6. A system according to claim 5, wherein the proximity sensor detects the target only in the first position.

7. A system according to claim 5, wherein the proximity sensor is an inductive sensor.

8. A system according to claim 5, wherein the proximity sensor is a capacitive sensor.

9. A system according to claim 5, wherein the proximity sensor is an optical sensor.

10. A system according to claim 5, wherein the target is attached to a control element which controls the opening and closing of the gripper.

11. A system according to claim 5, wherein the target comprises a control element which controls the opening and closing of the gripper.

12. A system according to claim 11, and including a cam, wherein the control element comprises a cam follower which follows the perimeter of the cam, the grippers being open when the cam follower is on a first portion of said perimeter, and closed when the cam follower is on a second portion of said perimeter.

13. A system according to claim 12, and including a control rod attached to the gripper, and a lever joining the control rod to the cam follower, wherein when the cam follower is on the first portion of the perimeter of the cam, the lever rotates the control rod into an orientation where the gripper is open, and when the cam follower is on the second portion of the perimeter of the cam, the lever rotates the control rod into an orientation where the gripper is closed.

14. A system according to claim 12, and including a cam stopper, wherein the cam does not rotate when the cam stopper is engaged, and the cam rotates substantially in synchrony with the impression roller when the cam stopper is disengaged, thereby preventing the gripper from opening when the cam stopper is disengaged and the cam follower is on the first portion of the perimeter of the cam.

15. A system according to claim 14, wherein friction keeps the cam rotating substantially in synchrony with the impression roller when the cam stopper is disengaged.

16. A system according to claim 1, further comprising:

a cam rotating about an axis about which the impression roller rotates; and a cam stopper, wherein the cam stopper comprises a first cam stopper element which is attached to the cam, and a second cam stopper element which does not rotate about the axis about which the impression roller rotates, and wherein the cam stopper elements engage each other to engage the cam stopper, thereby stopping rotation of the cam, and wherein the cam stopper elements disengage each other to disengage the cam stopper, thereby allowing the cam to rotate freely.

17. A system according to claim 16, and including an actuator which moves second cam stopper element into a first position where the second cam stopper engages the first cam stopper element, and into a second position where the second cam stopper disengages the first cam stopper element.

18. A system according to claim 17, wherein the cam only stops at a stopping position, and the second cam stopper element moved by the actuator does not interfere with the rotation of the cam when the second element is in the first position, until the cam is substantially in the stopping position.

19. A system according to claim 16, wherein one of the cam stopper elements is a hook.

* * * * *